US006047782A

United States Patent [19]

Ballard et al.

[11] Patent Number: 6,047,782

[45] Date of Patent: Apr. 11, 2000

[54] ASSEMBLY AND METHOD FOR EXTRACTING DISCRETE SOIL SAMPLES

[75] Inventors: John H. Ballard, Clinton; Bobby E. Reed, Vicksburg, both of Miss.

[73] Assignee: The United States of America as represented by the Secretary of the Army, Washington, D.C.

[21] Appl. No.: 08/965,264

[22] Filed: Nov. 6, 1997

[51] Int. Cl.[7] ..... E21B 49/02

[52] U.S. Cl. ..... 175/20; 175/52; 175/58; 175/122; 175/203; 175/309

[58] Field of Search ..... 175/20, 52, 58, 175/122, 135, 170, 203, 309

[56] References Cited

U.S. PATENT DOCUMENTS

| | | | |
|---|---|---|---|
| H1780 | 2/1999 | Melega | 175/20 |
| 3,872,935 | 3/1975 | Mielke | 175/20 X |
| 4,953,637 | 9/1990 | Starr et al. | 175/20 |
| 5,186,263 | 2/1993 | Kejr et al. | 175/20 |
| 5,211,249 | 5/1993 | Richter et al. | 175/20 |
| 5,474,140 | 12/1995 | Stevens | 175/20 |
| 5,488,876 | 2/1996 | Casey et al. | 73/864.44 |
| 5,587,540 | 12/1996 | Meyer | 175/20 X |
| 5,606,139 | 2/1997 | Wittig et al. | 73/864.44 |

*Primary Examiner*—Roger Schoeppel
*Attorney, Agent, or Firm*—Luther A. Marsh

[57] ABSTRACT

An assembly for extracting discrete soil samples from subsurface soil at a plurality of selected depths includes an elongated outer tubular housing, and a soil sample tube for disposal in the outer tubular housing. The soil sample tube is movable axially in the outer tubular housing and provided with a feature thereon for locking the soil sample tube in the outer tubular housing in a fully inserted position in the outer tubular housing. The replaceable soil sample tube defines a sample chamber proximate a distal end thereof. The assembly further includes a cone tip assembly including a cone tip member and a cone tip rod, the cone tip member being fixed to a distal end of the cone tip rod. The cone tip rod is movable axially in the soil sample tube, the cone tip member having a locking feature thereon for locking the cone tip member at the distal end of the soil sample tube with a cone portion of the cone tip member extending distally beyond a distal end of the outer tubular housing. A method for extracting soil samples, utilizing the above assembly, is also contemplated.

14 Claims, 3 Drawing Sheets

ASSEMBLY AND METHOD FOR EXTRACTING DISCRETE SOIL SAMPLES

BACKGROUND OF THE INVENTION

1. Field of the Invention

The invention relates to subsurface soil samplers and is directed more particularly to an assembly and method for extracting discrete soil samples from multiple downhole locations without having to remove the entire assembly after each extraction and without having to effect a wholly new penetration to obtain each new sample.

2. Description of the Prior Art

Conventional soil samplers, or "penetrometers", collect one soil sample per penetrometer push. The penetrometer typically is driven into the soil (a "push"), a sample of subsurface soil is collected, and the penetrometer is withdrawn from the soil. The captured soil sample is removed from the penetrometer and sent to a laboratory for analysis. To obtain another sample, the procedure is started all over with driving the penetrometer into the soil (another "push").

Alternatively, one may use a coring drill rig that collects a continuous core from the surface downward, or from a selected depth in a downhole downwards.

Neither device provides for acquisition of discrete soil samples collected from multiple downhole locations in the course of a single penetrometer push.

Accordingly, there is a need for a penetrometer-type soil sample assembly and a method by which one may capture discrete soil samples from multiple downhole locations during a single penetrometer push.

SUMMARY OF THE INVENTION

An object of the invention is, therefore, to provide an assembly for extracting discrete soil samples from multiple downhole locations in the course of a single assembly push into the soil.

A further object of the invention is to provide a method for extracting discrete soil samples from multiple downhole locations, the method requiring only one direct push procedure.

With the above and other objects in view, as will hereinafter appear, a feature of the present invention is the provision of an assembly for extracting discrete soil samples from subsurface soil at a plurality of selected depths. The assembly comprises an elongated outer tubular housing, and a soil sample tube for disposal in the outer tubular housing. The soil sample tube is movable axially in the outer tubular housing and is provided with means thereon for locking the soil sample tube with extended cone tip member in the outer tubular housing in a fully inserted position in the outer tubular housing. The soil sample tube defines a sample chamber proximate a distal end thereof. The assembly further includes a cone tip assembly comprising a cone tip member and a cone tip rod, the cone tip member being fixed to a distal end of the cone tip rod, the cone tip rod being movable axially in the soil sample tube. The cone tip member is provided with locking means thereon for locking the cone tip member at the distal end of the soil sample tube with a cone portion of the cone tip member extending distally beyond a distal end of the outer tubular housing.

In accordance with a further feature of the invention, there is provided a method for extracting discrete soil samples from a plurality of locations, the method comprising the steps of providing an assembly comprising a rigid outer tubular housing having an open distal end, a soil sample tube slidably disposed in the outer tubular housing and having an open distal end, and a cone tip assembly disposed in the soil sample tube, the cone tip assembly including a cone tip member at a distal end thereof, the cone tip member having a point at the cone tip member distal end and being configured to close the soil sample tube open distal end and the outer tubular housing open distal end. The method further includes the steps of driving the assembly into soil to a selected first depth, raising the cone tip assembly to expose the soil sample tube open distal end and the outer tubular housing open distal end, driving the outer tubular housing and the soil sample tube deeper into the soil to force a first sample of the soil through the open end of the soil sample tube into a soil sample chamber defined in part by the soil sample tube, and raising the soil sample tube in the outer tubular housing with the first sample in the soil sample chamber to move the first sample free of the outer tubular housing.

The above and other features of the invention, including various novel details of construction and combinations of parts, will now be more particularly described with reference to the accompanying drawings and pointed out in the claims. It will be understood that the particular device and method embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 1:
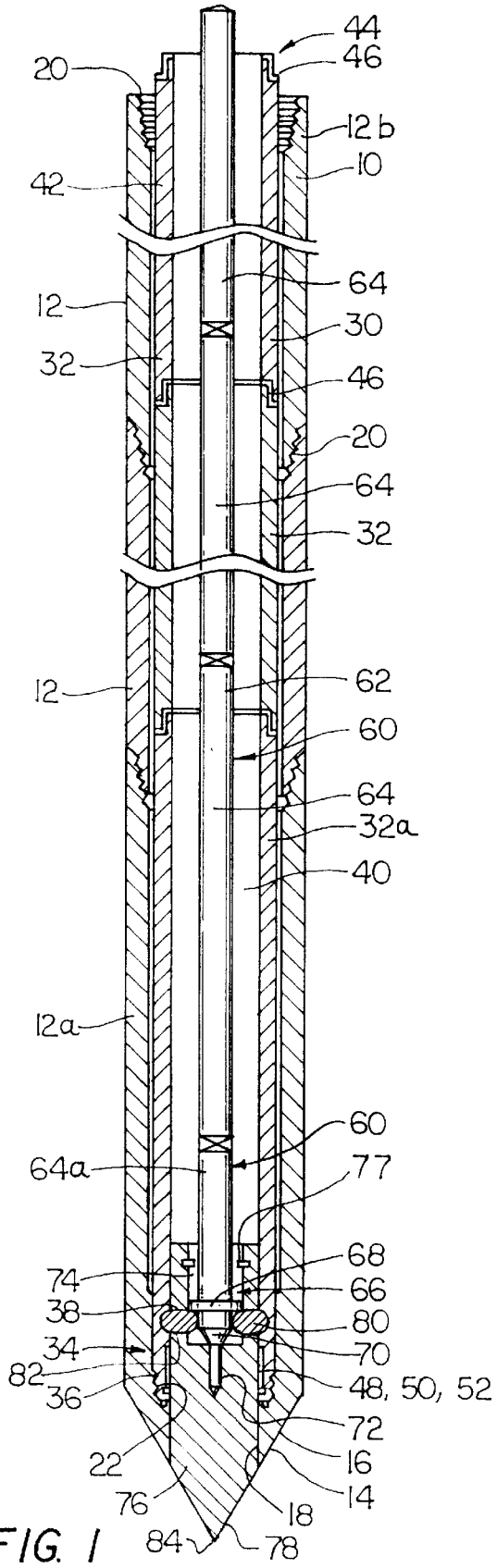
FIG. 1 is a partly sectional view and partly side elevational view of one form of assembly illustrative of an embodiment of the invention.

Referring to FIG. 1, it will be seen that a preferred assembly for extracting discrete soil samples from subsurface soil includes an elongated outer tubular housing 10. The housing 10 preferably is of metal, such as steel, and preferably includes a selected number of interchangeable sections 12 which may be fitted together end-to-end to provide an outer housing of a selected length and thereby adapted to be driven to a selected depth in the soil. A distal end 14 of a distal-most section 12*a* is of a frusto-conical configuration with a cone-shaped outer wall 16 and a central opening 18. A proximal-most section 12*b* is provided with connecting means, which may be in the form of threads 20, for accepting another section 12, if needed in a soil penetrating operation.

The assembly further includes a soil sample tube 30 comprising an elongated rigid tube of metal, preferably steel, slidably moveable in the outer housing 10. The soil sample tube 30 includes a plurality of sections 32 fitted together end-to-end to provide a selected length of soil sample tube. A distal-most soil sample tube section 32*a* is provided, at a distal end 34 thereof, with connecting means, such as threads 36 for engagement with complementary connecting means, such as threads 22 on the interior of outer housing section 12*a*, to secure the soil sample tube 30 in the outer housing 12 in a position in which the soil sample tube 30 is fully extended in the outer housing 10. The distal-most section 32*a* of the soil sample tube 30 is further provided with an annular recess 38 proximate the distal end 34 of the soil sample tube distal-most section 32*a*. The distal-most section 32*a* of the soil sample tube 30 defines a sample chamber 40. A proximal-most section 42 of the soil sample tube 30 is provided at a proximal end 44 thereof with a connection means, such as tongue and groove connection means 46 for receiving another of the soil sample tube sections, as needed for additional sample collection.

Figure 2:
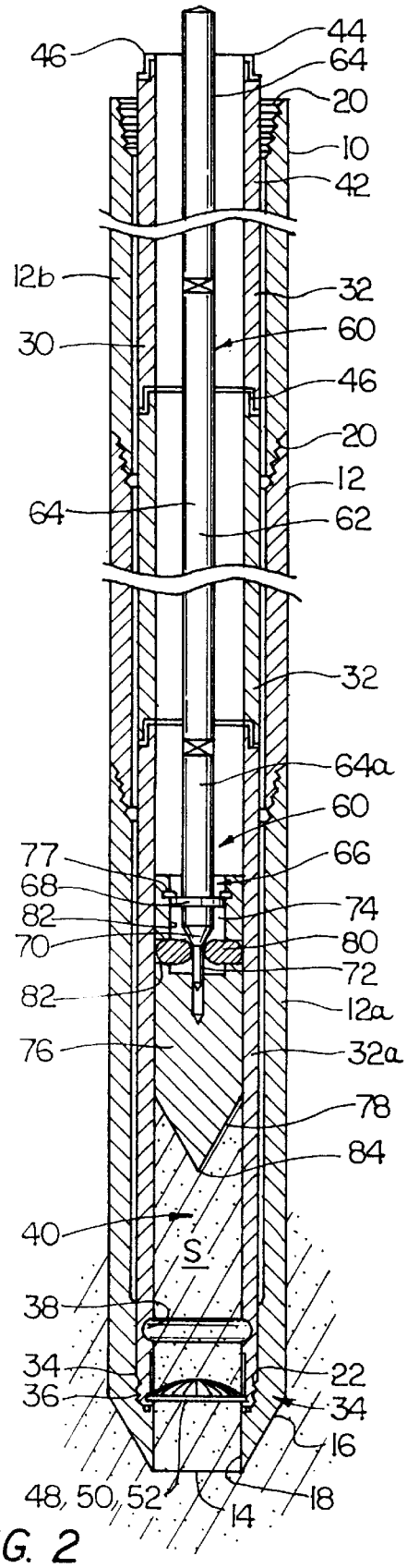
FIGS. 2 and 3 are similar to FIG. 1, but illustrating various components of the assembly of FIG. 1 in different operative positions.

Held at the distal end 34 of the distal-most section 32*a* of the soil sample tube 30 is a one-way valve 48 which constitutes a soil trap 50 having fingers 52 which remain open (FIG. 1) in drilling operations and spring closed (FIG. 2) after a soil sample is collected, as will be further described hereinbelow.

The soil sample extracting assembly still further includes a cone tip assembly 60 including a rod 62, preferably of steel, and preferably consisting of a plurality of rod sections 64 connected together end-to-end to provide a selected length of rod 62. A distal end 66 of a distal-most rod section 64a is provided with an annular flange 68, a frusto-conically shaped cam portion 70 and an axially extending pin portion 72. The flange 68 is reciprocally movable in a chamber 74 in a cone tip member 76 having a cone tip portion 78.

Proximal movement of the flange 68 is limited by a stop ring 77 extending into the chamber 74. Distally of the flange 68, the rod 62 engages a series of locking pins 80 retained in holes 82 in cone tip member 76 and extendible outwardly from the cone tip member holes 82 to nest in the soil sample tube annular recess 38, as shown in FIG. 1.

In use, the assembly is in the arrangement shown in FIG. 1 for soil penetration purposes. The outer housing cone-shaped outer wall 16 and the cone tip assembly cone tip portion 78 together form a point 84 for soil penetration. The entire assembly, as shown in FIG. 1, is driven into the soil as by hydraulic ram force, or other push force mechanism (not shown). As the assembly progresses into the soil, new rod sections 64, soil sample tube sections 32, and outer housing sections 12 are added end-to-end to provide the penetration depth desired. The fingers 52 of the soil trap 50 are held open by the cone tip member 76.

Upon reaching a desired depth, the rod 62 is raised, or moved proximally, to disengage the large diameter portion of the distal-most rod section 64*a* from the locking pins 80, allowing the locking pins to ride down the cam portion 70 of the rod section 64*a* and to settle inwardly on the pin portion 72 of the rod 62. The locking pins 80 are thus allowed to move inwardly from the soil sample tube recess 38 to render the cone tip assembly 60 moveable in the soil sample tube 30. Because the flange 68 engages the stop ring 77 (FIG. 2), further proximal movement of the rod 62 draws the cone tip member 76 proximally to open the distal end 34 of the soil sample tube 30. The outer housing 10, with the soil sample tube 30 fixed therein, is then driven deeper into the soil, forcing soil into the sample chamber 40. When driving of the housing 10 and soil sample tube 30 stops, the fingers 52 of the soil trap 50, which are spring-biased toward a closed position, are urged inwardly toward the closed position.

Figure 3:
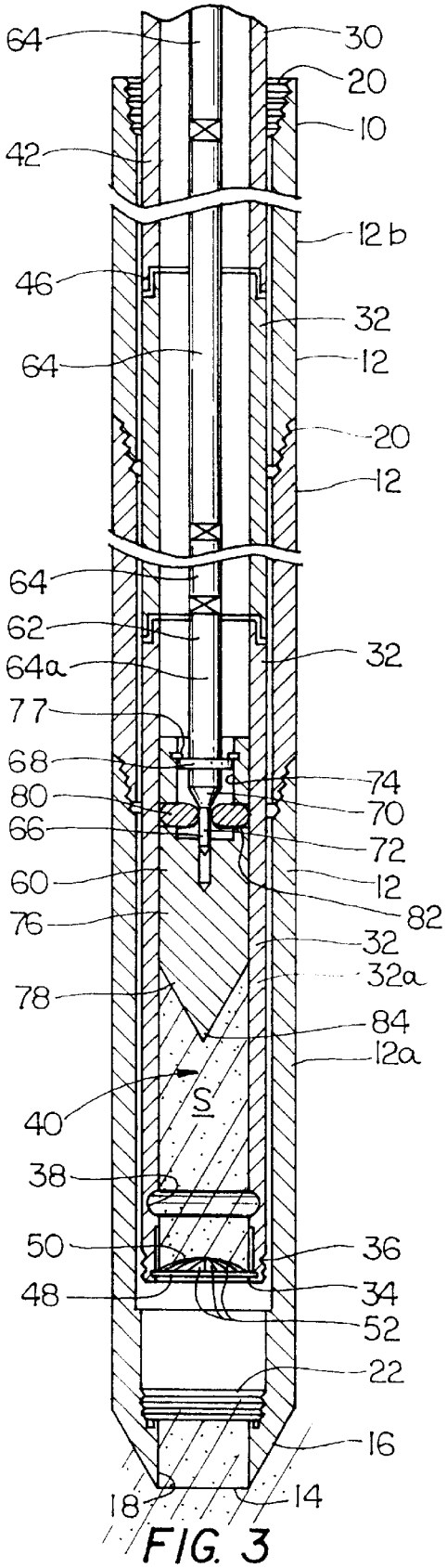

After a soil sample S has been captured, the soil sample tube 30 is rotated in the outer housing 10 to disconnect the soil sample threads 36 from the outer housing threads 22, to free the soil sample tube 30 for axial movement in the outer housing 10 (FIG. 3). The soil sample tube 30 and cone tip assembly 60 are then lifted from the housing 10. As the tube 30 and assembly 60 are raised, the proximal-most sections 42, 64 may be removed for storage. When the distal-most soil sample section 32*a*, having the sample chamber 40 and soil trap 50 therein, reaches the surface, it may be emptied and re-used, or alternatively, may be retained for storage of soil sample therein, and replaced with another soil sample tube distal-most section.

The outer tubular housing is retracted a minimum distance (<6 inches) to facilitate the replacement of the soil sample tube with an extended cone tip assembly. The soil sample tube is placed in the locked position with cone tip assembly extended out the distal end of the outer tubular housing in the push position. Multiple soil tube replacements are performed to collect multiple soil samples at discrete locations without withdrawing of the outer tubular housing.

Figure 4:
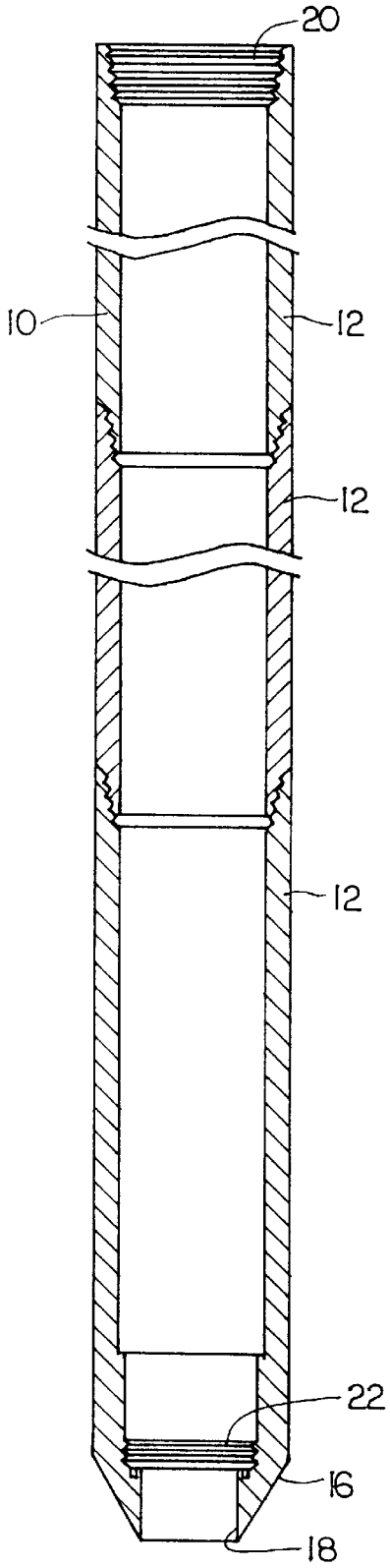
FIG. 4 is a sectional view of one component of the assembly of FIGS. 1–3.
Figure 5:
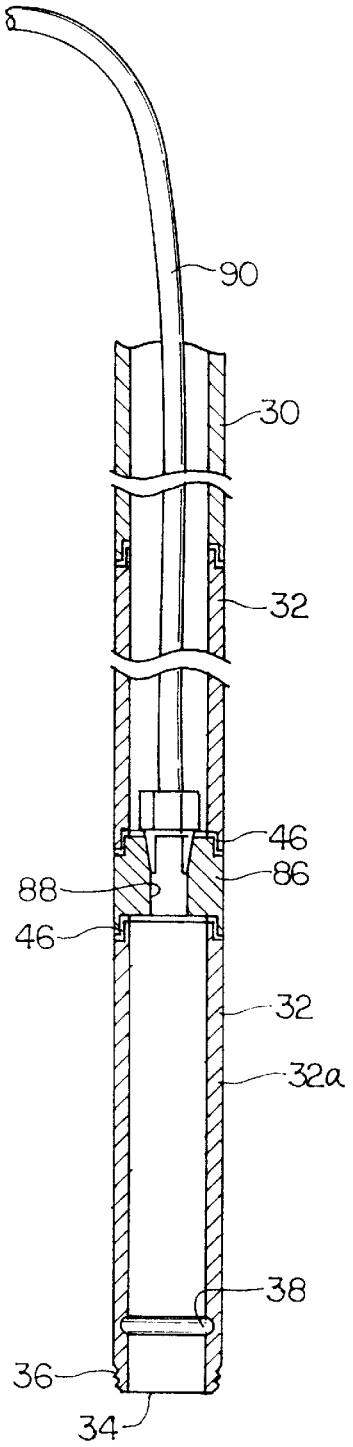
FIG. 5 is a sectional view, partly in elevation, of another component of the assembly of FIGS. 1–3, shown in combination with a grouting assembly.

In FIG. 4, there is shown the outer tubular housing 10 with the soil sample tube and the cone tip assembly removed. If another sample of soil is desired, the outer tubular housing 10, soil sample tube 30 and cone tip assembly 60 are replaced or reassembled, as shown in FIG. 1, and driven deeper into the soil until reaching the depth of a second location from which a soil sample is desired, whereupon a second soil sample is collected and withdrawn. In such manner, the assembly may be used for soil sample taking at several depths, without having to retract the outer tubular housing to the surface and push the outer tubular housing from the surface each time, but merely slightly deeper than the depth at which the housing has already been driven.

Upon completion of retrieval of the last soil sample, the soil tube assembly is removed and the soil sample tube 30 is provided with the soil trap 50 removed and with a grout nozzle 86 fitted between two of the soil sample tube sections 32. The grout nozzle 86 is provided with a central orifice 88 and is connected to a grout tube 90 which extends through the soil sample tube 30 from a grout pump (not shown) in communication with a grout source (not shown).

Figure 6:
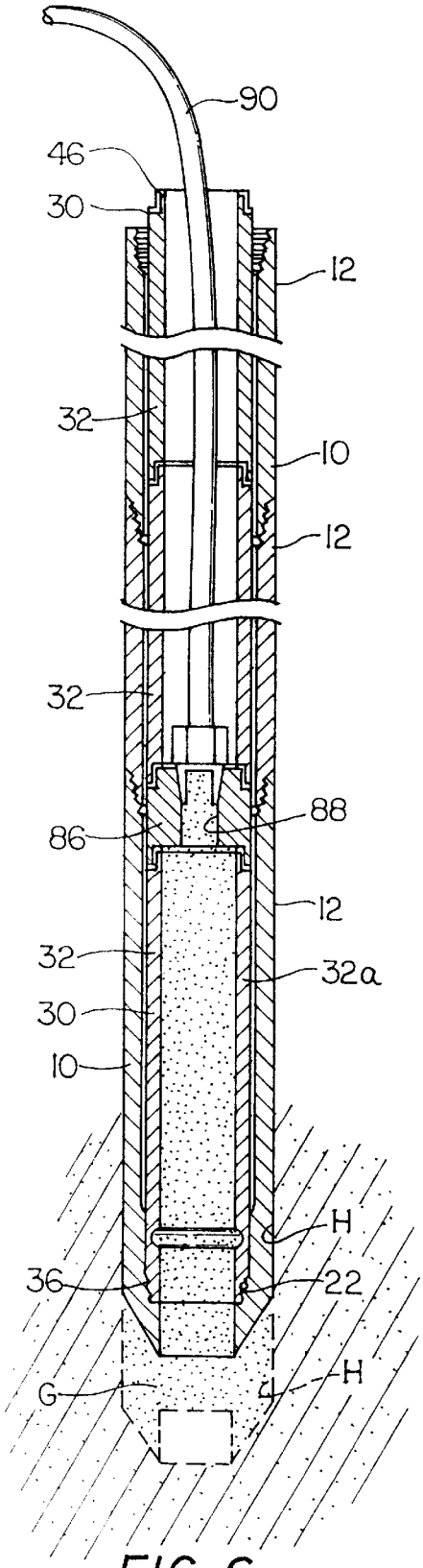
FIG. 6 is a sectional view of the components of FIGS. 4 and 5 in combination.

The soil sample tube 30 is locked to the outer tubular housing 10 by threads 22, 36. The assembly of outer tubular housing 10 and soil sample tube 30 is then raised and, simultaneously, grout is conveyed through the grout tube 90, grout orifice 88 and of grout nozzle 86, and through the soil sample tube distal-most section 32*a*, and out the distal end 34 of the soil sample tube distal-most section 32*a* (FIG. 6), to fill the down-hole H with grout G. Thus, any contaminants at a given soil level cannot move through the down-hole H to other levels, and/or the surface.

There is thus provided an assembly and method for extracting discrete soil samples from multiple downhole locations in the course of a single penetrometer push into the soil, and for sealing the down-hole thereby created.

It is to be understood that the present invention is by no means limited to the particular construction herein disclosed and/or shown in the drawings, but also comprises any modifications or equivalents within the scope of the claims.

What is claimed is:

1. An assembly for extracting discrete soil samples from subsurface soil at a plurality of selected depths, said assembly comprising:

an elongated outer tubular housing;

a soil sample tube for disposal in said outer tubular housing, said soil sample tube being movable axially in said outer tubular housing and having means thereon for locking said soil sample tube in said outer tubular housing in a fully inserted position in said outer tubular housing, said soil sample tube defining a sample chamber proximate a distal end thereof; and a cone tip assembly comprising a cone tip member and a cone tip rod, said cone tip member being fixed to a distal end of said cone tip rod, said cone tip rod being movable axially in said soil sample tube, said cone tip member having locking means thereon for locking said cone tip member at said distal end of said soil sample tube with a cone portion of said cone tip member extending distally beyond a distal end of said outer tubular housing.

2. The assembly in accordance with claim 1 and further comprising a grout nozzle for communication with a grout source, said nozzle being mountable in said soil sample tube when said cone tip member and cone tip rod are removed from said soil sample tube, and adapted to flow grout through said soil sample tube and into a down-hole created by said assembly, said grout being flowed as said outer tubular housing and said soil sample tube are raised through said subsurface soil to expose said downhole.

3. The assembly in accordance with claim 1 wherein said locking means for locking said cone tip member in said soil sample tube is operable by axial movement of said cone tip rod to lock and unlock said cone tip assembly to and from said soil sample tube.

4. The assembly in accordance with claim 3 wherein said locking means on said cone tip member for locking said cone tip member in said soil sample tube comprises an expandable series of pins disposed around a reduced diameter portion of said cone tip rod, said cone tip rod having a frusto-conically shaped cam portion engageable with said pins to expand said pins, said sample tube having an internal recess for receiving said pins.

5. The assembly in accordance with claim 4 wherein proximal axial movement of said cone tip rod in said soil sample tube unlocks said cone tip assembly from said soil sample tube to permit proximal movement of said cone tip assembly in said soil sample tube to permit soil to enter said distal end of said soil sample tube to enter said sample chamber.

6. The assembly in accordance with claim 5 wherein said one-way valve is operable to close said sample chamber to prevent loss of soil therefrom upon said sample tube and said cone tip assembly withdrawal from said outer tubular housing.

7. The assembly in accordance with claim 1 wherein said soil sample tube comprises a series of separable tubular segments, a distal-most of said segments comprising said sample chamber.

8. The assembly in accordance with claim 1 wherein said means for locking said soil sample tube in said outer tubular housing is releasable by rotative movement of said soil sample tube in said outer tubular housing, to permit withdrawal of said soil sample tube and said cone tip assembly from said outer tubular housing.

9. The method in accordance with claim 1 including the additional steps of:

locking said cone tip assembly in said soil sample tube;

replacing said soil sample tube with said cone tip assembly in said outer tubular housing; and locking said soil sample tube in said outer tubular housing;

prior to said driving of said extraction assembly into soil.

10. The method in accordance with claim 9 including the additional steps of:

unlocking said cone tip assembly from said soil sample tube prior to said raising of said cone tip assembly; and unlocking said soil sample tube from said outer tube housing prior to said raising of said soil sample tube.

11. The method in accordance with claim 10 wherein said outer tubular housing, said soil sample tube, and said cone tip assembly are each provided in sections connectable end-to-end, and wherein in said driving of said extraction assembly into soil, said sections are added as said extraction assembly is driven deeper, and wherein upon said raising of said cone tip assembly, and said raising of said soil sample tube, and wherein upon raising of said outer tubular housing, sections thereof are removed serially.

12. A method for extracting discrete soil samples from a plurality of locations, the method comprising the steps of:

providing an extraction assembly comprising a rigid outer tubular housing having an open distal end, a soil sample tube slidably disposed in said outer tubular housing, defining in part a soil sample chamber, and having an open distal end, and a cone tip assembly disposed in said soil sample tube, said cone tip assembly including a cone tip member at a distal end thereof, said cone tip member having a point at the cone tip member distal end and being configured to close said soil sample tube open distal end and said outer tubular housing open distal end;

driving said extraction assembly into soil to a selected first depth;

raising said cone tip assembly to expose said soil sample tube open distal end and said outer tubular housing open distal end;

driving said outer tubular housing and said soil sample tube deeper into the soil, to force a first sample of the soil through said open end of said soil sample tube into said soil sample tube;

raising said soil sample tube in said outer tubular housing with said first sample in said soil sample chamber, to move said first sample free of said outer tubular housing.

13. The method in accordance with claim 12 including the additional steps of removing said soil sample tube and said cone tip assembly from said outer tubular housing, removing said soil sample from said soil sample tube, returning said soil sample tube to said outer tubular housing and said cone tip assembly to said soil sample tube, and driving said extraction assembly deeper into said soil for capture of another soil sample.

14. The method in accordance with claim 12 including the additional steps of removing said soil sample tube and said cone tip assembly from said outer tubular housing, removing a last soil sample from said soil sample tube, returning said soil sample tube and grout nozzle to said outer tubular housing, raising said outer tubular housing and said soil sample tube to expose a down-hole created by said driving of said extraction assembly into the soil, and flowing grout through said soil sample tube to fill said down-hole as said outer tubular housing and said soil sample tube are raised.

* * * * *